US006296142B1

(12) United States Patent
Nguyen

(10) Patent No.: US 6,296,142 B1
(45) Date of Patent: Oct. 2, 2001

(54) COUNTER BALANCE SPRING ASSEMBLY

(75) Inventor: Son T. Nguyen, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/326,336

(22) Filed: Jun. 7, 1999

(51) Int. Cl.[7] ..... B65D 43/16; E05F 1/10

(52) U.S. Cl. ..... 220/830; 220/264; 220/827; 206/710; 49/386; 16/277; 16/286; 16/289

(58) Field of Search ..... 220/260, 263, 220/264, 827, 830, 828; 16/277, 286, 289, 290, 298–301, 306, 72; 49/386, 387; 312/319.4, 319.2; 206/710, 711

(56) References Cited

U.S. PATENT DOCUMENTS 1,930,841 * 10/1933 Miniere ..... 220/827
2,046,892 * 7/1936 Blum ..... 16/72
3,307,734 * 3/1967 Campbell ..... 220/827
3,712,248 * 1/1973 Floehr ..... 49/386
3,737,947 * 6/1973 Little ..... 16/306
3,906,587 * 9/1975 Little ..... 16/306
4,091,502 * 5/1978 Little ..... 16/306
5,465,862 * 11/1995 Devlin ..... 220/830

* cited by examiner

*Primary Examiner*—Nathan J. Newhouse
(74) *Attorney, Agent, or Firm*—Thomason, Moser & Patterson, LLP

(57) ABSTRACT

A counter balance assembly for a lid assembly comprising a spring inside a housing assembly. The counter balance assembly is mounted to a lid, whose displacement generates an external force substantially along a longitudinal axis of the spring. A restoring force is generated by the spring to counteract an inertia force arising from the lid displacement.

14 Claims, 5 Drawing Sheets

COUNTER BALANCE SPRING ASSEMBLY

BACKGROUND OF THE DISCLOSURE

1. Field of the Invention

The invention relates to a lid closure and lift mechanism and, more particularly, to a counter balance spring assembly.

2. Description of the Background Art

In a wafer processing system, a lid assembly for a processing chamber is typically rather heavy. To ensure safety for operating personnel, various mechanisms have been used to facilitate the closing or opening of the lid—for example, by reducing the force necessary to effect movement of the lid. In one arrangement, gas springs, or cylinders, are mounted onto a lid assembly to provide a force to assist lifting the lid during opening. Another arrangement uses a spring mechanism which generates a restoring force in response to an external torsional force exerted on the spring during closing or opening of the lid. Typically, a spring is housed inside a hinge-like structure, and is subjected to a torsional force when the lid is opened or closed. This torsional force leads to a compression of the spring, which in turn generates a restoring force resulting in an opposite torsional component. However, the torsional motion in such a mechanism causes particulate contamination due to friction between the spring and its housing. For wafer processing applications, such particulate contamination has to be minimized to avoid decreasing yields on the wafers.

Therefore, there is an ongoing need for alternative counter balance mechanisms which facilitate the opening and closing of lids, while minimizing particulate contamination for wafer processing systems.

SUMMARY OF THE INVENTION

The present invention is a counter balance assembly for a lid assembly. The counter balance assembly (or mechanism) comprises a spring inside a housing assembly which is mounted on a lid of a chamber. When the lid is opened and the counter balance assembly is engaged, an external force is generated which acts along a longitudinal axis of the spring. The external force compresses the spring such that a restoring force is generated. This restoring force increases with increasing lid displacement, and acts in a direction opposite to that of lid displacement.

In one embodiment of the invention, the counter balance assembly is used in a lid assembly for a wafer processing system. The housing assembly is mounted on a lid, which is hingedly mounted over a wafer processing chamber. The housing assembly comprises a top housing member and a bottom housing member, which are connected at a certain distance apart from each other by a screw, which allows relative movement between the two housing members. The top housing member is attached to the lid. When the lid is opened to a predetermined angular displacement, the bottom housing member presses against a chamber wall. An external force is generated such that the bottom housing member is pushed closer to the top housing member, thus compressing the spring inside the housing assembly. A restoring force resulting from the compression of the spring acts in a direction opposite to that of the lid displacement, and reduces the force necessary to keep the lid from falling backwards under its own weight. The use of the counter balance assembly promotes safe operation of the lid assembly by ensuring that the force needed for lid closing stays below a prescribed safety limit.

BRIEF DESCRIPTION OF THE DRAWINGS

The teachings of the present invention can be readily understood by considering the following detailed description in conjunction with the accompanying drawings, in which:

FIG. 2*b* depicts a cross-sectional view of the counter balance assembly of FIG. 2*a; * and FIG. 3 illustrates various forces acting upon different components of the lid assembly of FIG. 1*a.

To facilitate understanding, identical reference numerals have been used, where possible, to designate identical elements that are common to the figures.

DETAILED DESCRIPTION

Figure 1:
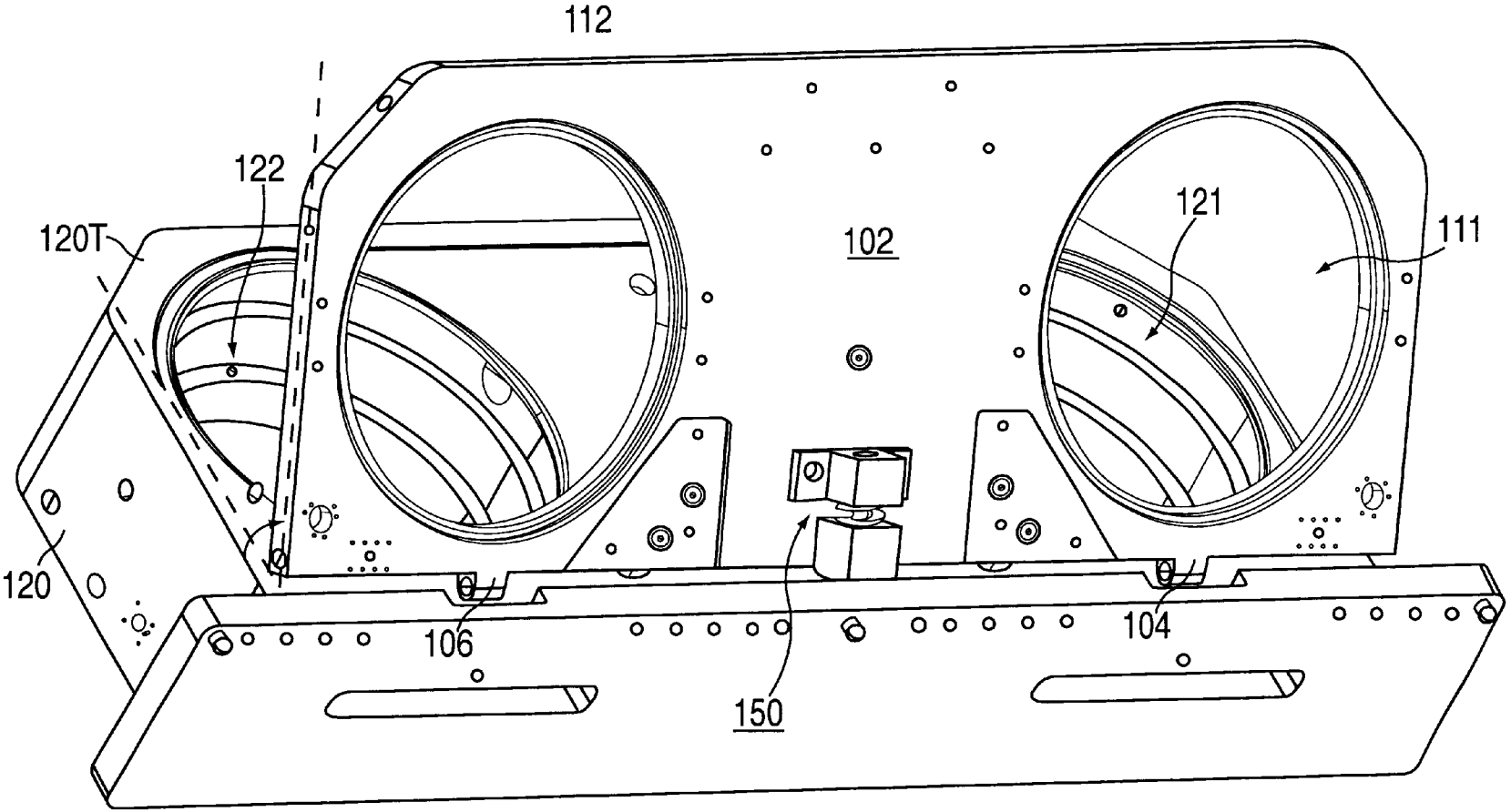
FIG. 1 depicts a perspective view of a lid assembly of a wafer processing system incorporating a counter balance assembly of the present invention.

FIG. 1*a* depicts a perspective view of a lid assembly 100 in a wafer processing system (not shown) incorporating a counter balance assembly 150 of the present invention. A lid assembly 100 may comprise, in general, of a lid 102 having associated attachments or accessories (not shown) such as gas manifolds, mounting mechanisms, and so on. An example of a wafer processing system incorporating the counter balance assembly 150 is a 200 mm Producer system (not shown) for thin film deposition, which is available from Applied Materials, Inc., of Santa Clara, Calif. The Producer wafer deposition system has a twin, or dual chamber arrangement, which allows wafers to be processed simultaneously in two chambers. Furthermore, a cleaning chamber, a remote plasma source (RPS) chamber, is mounted on top of the lid 102. As such, the Producer system has a lid assembly 100 which is much heavier than other wafer processing systems. Since the center of gravity in this design is above the plane of the lid 102, the lid 102 has a tendency to fall backwards even before it is opened to its vertical position. In this embodiment, the lid 102 has two openings 111, 112, each of which is aligned with two other openings 121, 122 provided at the top 120T of a dual-chamber body 120. The counter balance assembly 150 is disposed between two hinges 104, 106, which allow the lid 102 to be mounted onto a wall, or ledge 125, of the chamber body 120.

Figure 2A:
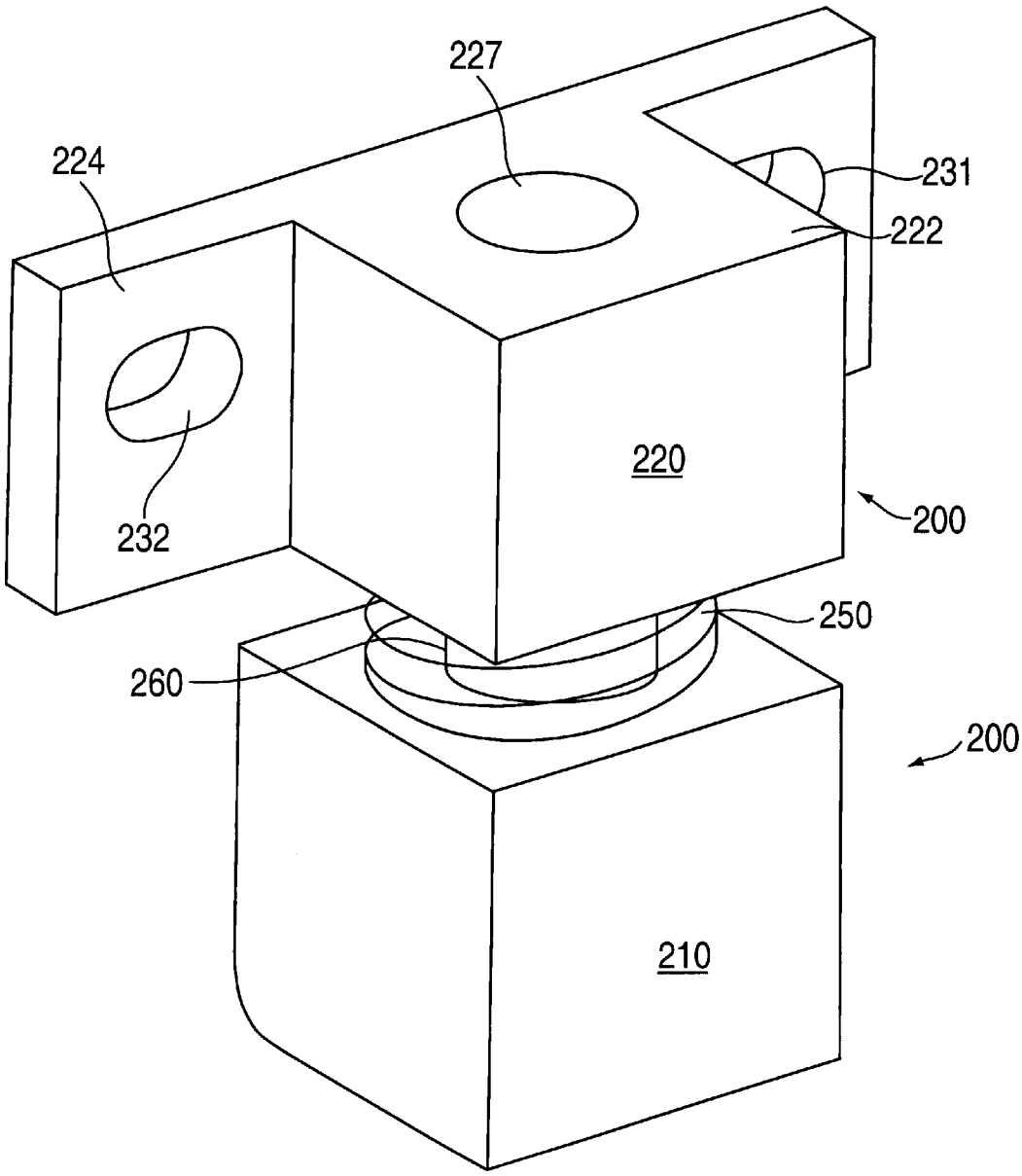
FIG. 2*a* depicts an expanded, perspective view of the counter balance assembly of FIG. 1.
Figure 2B:
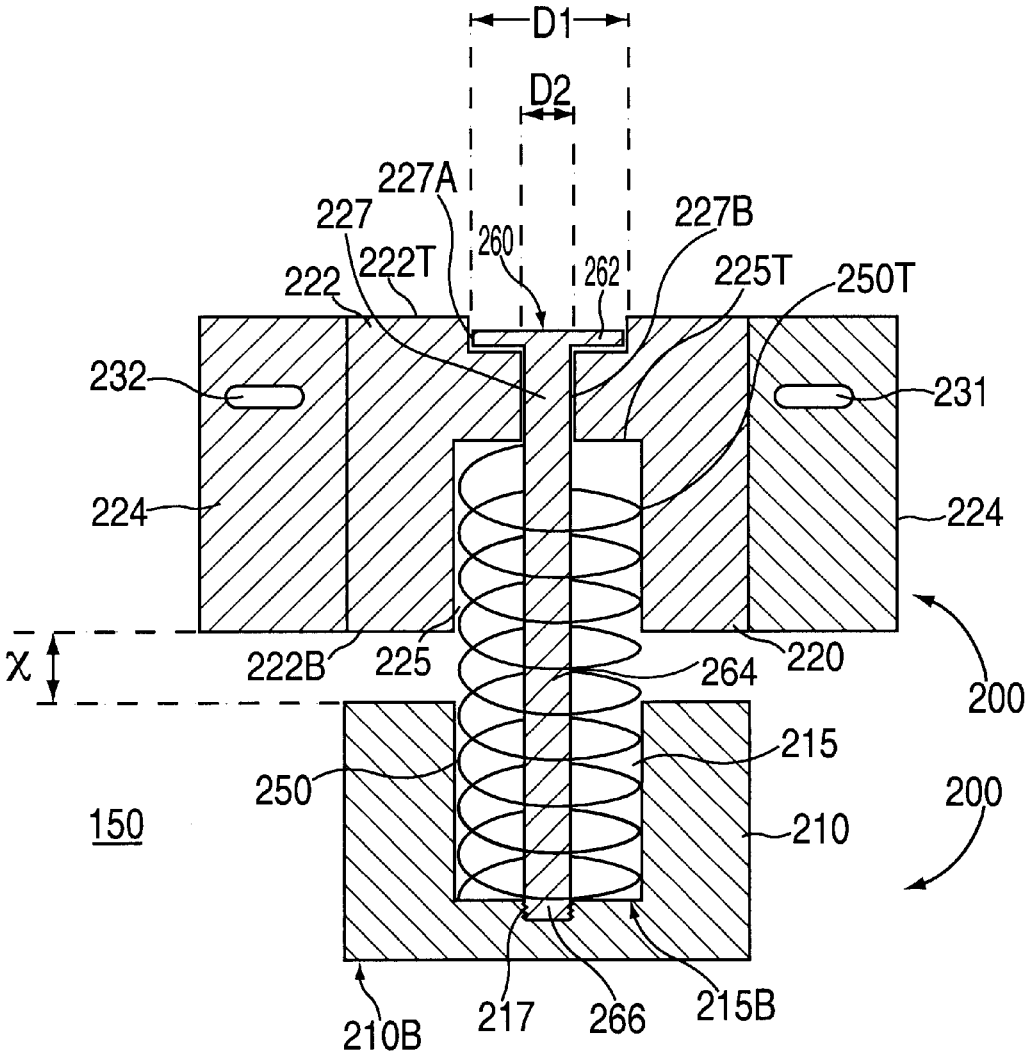

FIG. 2*a* depicts an expanded, perspective view and FIG. 2*b* depicts a cross-sectional view of the counter balance assembly 150, which comprises a spring 250 inside a housing assembly 200. In one embodiment, the housing assembly 200 further comprises two parts—a bottom housing member 210 which is substantially cubicle, and a top housing member 220 which has a cubicle portion 222 attached to an elongated rectangular flange 224. The bottom housing member 210 has an opening 215 sized to accommodate the spring 250, which protrudes partially out of the bottom housing member 210. The bottom housing member 210 is provided with a tapped hole 217 at the bottom 215B of the opening 215.

FIG. 2*b* shows the top housing member 220 having an opening 225 extending from the bottom surface 222B of the cubicle portion 222 to a certain distance inside the top housing member 220. The opening 225 is sized to accommodate the top portion 250T of the spring 250. The top 225T of this opening 225 is connected to a counter-bored opening 227, extending from the top surface 222T of the cubicle portion 222 of the top housing member 220. The counterbored opening 227 has a portion 227*a* (with diameter d1) which is large enough to accommodate the head 262 of a screw 260, and a smaller portion 227*b* (with diameter d2) which connects with the opening 225. The screw 260 has an elongated portion 264 which fits along a longitudinal axis inside the spring 250 and the opening 225 of the top housing member 220. A threaded portion 266 of the screw 260 threads into the tapped hole 217 of the bottom housing member 210. As such, the spring 250, the top housing member 220 and the bottom housing member 210 are assembled by the screw 260 to form a counter balance assembly 150, with the spring 250 being subjected to a slight compression inside the housing assembly 200. In this assembled state, the top housing member 220 and the bottom housing member 210 are spaced apart by a certain distance x. If the top housing member 220 is held fixed and an external force is applied against the bottom 210B of the bottom housing member 210, the distance x between the top and bottom housings 220, 210 is decreased, and the spring 250 is thereby compressed inside the housing assembly 200. The screw 260, however, remains free to slide (in an up and down direction within the 227 and 225) with respect to the top housing member 220.

The counter balance assembly 150 is mounted onto the lid 102 by means of screws (not shown). Two slots 231, 232 on the rectangular portion 224 of the top housing member 220 and corresponding tapped holes (not shown) on the lid 102 are provided for this purpose. Referring to FIG. 1, as the lid 102 is opened about its pivot position, as defined by hinges 104, 106 in this case, the entire counter balance assembly 150 is tilted backwards along with the lid 102. When the lid 102 is opened further (increasing angular displacement θ), it reaches a position at which the bottom 210B of the bottom housing member 210 presses against the wall 125 (or ledge) of the chamber body 120. At this particular angle $\theta_c$, the counter balance assembly 150 is engaged—i.e., the distance x between the top and bottom housing members is decreased, and the spring 250 is compressed beyond its initial position inside the housing assembly 200. A restoring, or counter balancing force is therefore generated as a result of the compression of the spring 250, which serves to counteract the inertial force of the lid 102 resulting from the lid displacement θ. (In this case, the inertial force of the lid 102 tends to further open the lid 102, increasing the lid displacement θ.) The term "counteract" is used to generally denote a reduction of any effect (e.g., a torque acting about the lid pivot position) arising from the inertial force, and does not necessarily imply that the restoring force acts in exactly the opposite direction to the inertial force. As the spring compression increases with increasing lid displacement θ, so does the magnitude of the restoring force. The dimensions of the spring 250 and the screw 260 are selected to allow free compression of the spring 250 without any friction with the screw 260, thus avoiding possible particulate contamination.

Figure 3:
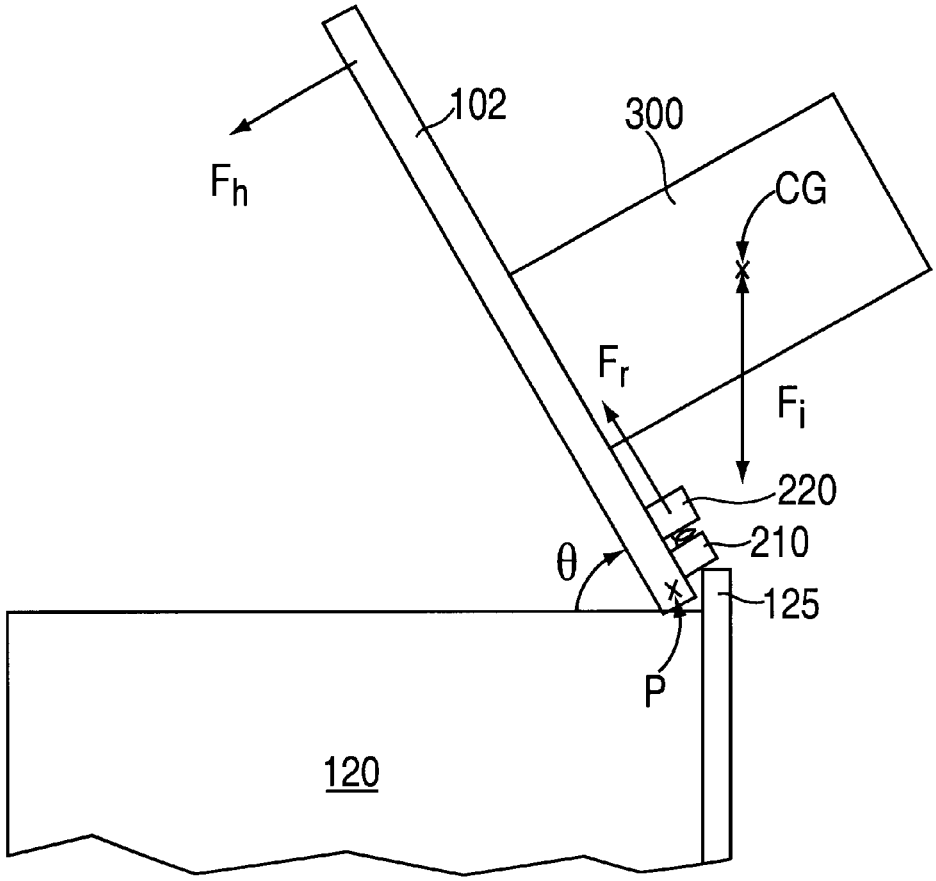

FIG. 3 is a simplified diagram illustrating some of the forces acting upon various components of the lid assembly 100, having an attached component 300 (e.g., a cleaning chamber) mounted onto the lid 102. The center of gravity of the lid assembly 100 is represented by CG, with an associated inertial force Fi acting generally in a downward direction. Upon opening the lid 102 about its pivot P, a restoring force Fr is generated by the compression of the spring 250 when the bottom housing member 210 is pressed against the wall 125 of the chamber body 120. The force required by operating personnel to handle the lid assembly 100 is represented by $F_h$, which can act generally along different parts of the lid 102 in different directions. The forces shown in FIG. 3 are meant to be illustrative only, and it is understood that different representations of force components may be used to convey the general concepts embodied in this invention.

In one embodiment of the present invention, the counter balance assembly 150 is designed to engage at a predetermined lid displacement angle $\theta_c$ of about 60 degrees from its closed, or reference position. This displacement threshold angle $\theta_c$ is selected, for example, for use with the Producer wafer deposition system, to ensure that the handle force required to open or close the lid 102 stays within certain safety limits. The restoring force from the compressed spring 250 counteracts the inertial force of the lid 102, and reduces the net handle force required for lid closure. Preferably, the spring 250 is selected with an appropriate spring constant such that the restoring force is sufficient to facilitate lid closure, but not too large to "spring" the lid 102 forward, which may otherwise make it difficult for operating personnel to keep the lid 102 open.

In the present embodiment, the top housing member 220 is made of stainless steel, and the bottom housing member 210 is made of delrin. The use of delrin for the bottom housing member 210 is preferred because it minimizes particulate contamination which may otherwise arise from friction between the bottom housing member 210 and the wall (or ledge) 125 of the chamber body 120. The spring 250 used in the present embodiment is made of chrome-vanadium steel, is available, for example, from McMaster-Carr as part number 9295K67. Of course, materials used for the spring 250 and the housing members 210, 220 are meant for illustrative purpose only, and other suitable alternatives can also be used in the practice of this invention. The specific designs of the top housing member 220 and the bottom housing member 210 represent one embodiment of the housing assembly 200 used to retain the spring 250 for the practice of the invention. Other design variations which appropriately retain the spring 250 and allow for spring compression as a function of lid displacement will also be effective in the practice of the invention.

Figure 4:
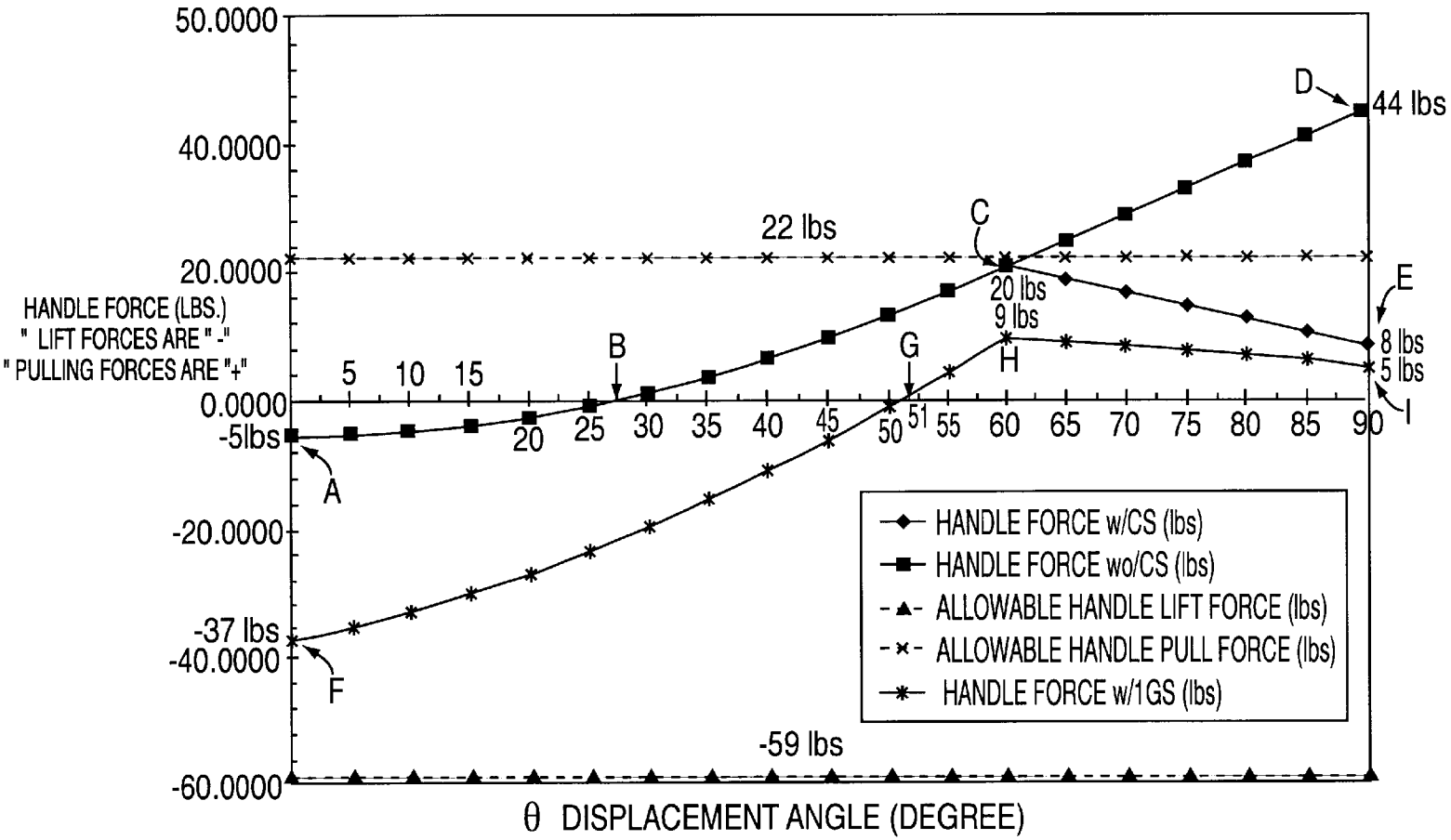
* and FIG. 4 depicts a plot of forces associated with opening or closing of a lid as a function of lid displacement angle.

FIG. 4 shows a plot of the handle forces (i.e., forces exerted by the operating personnel) associated with opening or closing the lid 102 as a function of the lid displacement angle θ. For example, the force associated with opening, or lifting, the lid 102 is referred to as the "lift" force, and is illustrated as negative (−) in the figure. The force associated with closing the lid 102 (or preventing the lid 102 from falling backwards under its own weight or inertia) is referred to as the "pull" force, which is illustrated as positive (+) in FIG. 4. Safety regulations impose maximum limits on forces required to manually open or close the lid 102. For example, the maximum allowed lift force cannot exceed about −59 lb., while the maximum allowed pull force cannot exceed about +22 lb. These safety limits are shown as dashed lines in the figure.

Line ABCD shows the force required in handling the lid 102 in the presence of two gas springs (not shown) mounted onto the lid assembly 100, but in the absence of any restoring force from the counter balance spring assembly 150. The two gas springs are mounted between the chamber body 120 and the lid 102 to assist in opening the lid 102—i.e., they reduce the force required to lift the lid 102. Starting from the closed position (reference position), illustrated by point A, the force required to open the lid 102 is a "lift" force of about −5 lb. As the lid 102 is opened gradually to an angular displacement $\theta_b$ of about 27 degrees, corresponding to point B in FIG. 4, the handle force becomes zero. This is a "balance point" at which the lid 102 should stay in a neutral position—i.e., the center of gravity and the pivot point (defined, for example, by the hinges 104, 106) of the lid 102 are in a vertical plane. If the lid 102 is opened beyond this "balance" angle $\theta_b$, the lid 102 will fall backwards (open) under its own weight (or inertial force), in the absence of other restraining force. An operating personnel will need to exert a "pull" force, illustrated by the segment BC, to keep the lid 102 from falling open at increasing lid displacement θ. This pull force acts to counterbalance a torque created by the inertial force of the lid about its pivot position defined by the hinges 104, 106. When the lid displacement angle reaches point C, about 60 degrees, the pull force required approaches the safety limit of 22 lb., as shown by the dashed line in FIG. 4. Without the counter balance assembly 150, the pull force required (shown as segment CD) will exceed the safety limit. However, when the counter balance assembly 150 is mounted onto the lid 102 so that it is engaged when the lid displacement angle θ exceeds about 60 degrees, the restoring force counteracts the inertial force of the lid 102 (i.e., reducing the resultant torque about the lid pivot position), as well as those from the gas springs. Therefore, the pull force required to keep the lid 102 from falling open stays below the safety limit. In this embodiment, the spring constant of the spring 250 is selected such that the required pull force decreases along the segment CE in approximately a linear fashion, from about 20 lb. at 60 degrees to about 8 lb. at 90 degrees of lid displacement. The lid 102 is prevented from opening beyond 90 degrees by a "hard" stop.

FIG. 4 also shows the force associated with lid opening or closing when only one gas spring is used with the lid assembly 100, and with the counter balance assembly 150 installed—e.g., to simulate the unlikely event of a gas spring failure. This is illustrated by the line FGHI, showing a much larger lift force (about −37 lb.) required to open the lid 102 at point F, compared to point A. A balance point G is reached when the lid 102 is opened to about 51 degrees, beyond which the pull force increases to about 9 lb. At point H, the counter balance assembly 150 is engaged, and the restoring force counteracts the inertial force of the lid 102 and that of the gas spring. As such, the counter balance assembly 150 reduces the pull force that is otherwise required to keep the lid 102 from falling open. Again, the restoring force increases with increasing displacement, resulting in a slight decrease in the required pull force as the lid displacement angle increases from 60 to 90 degrees, as shown by segment HI. As illustrated by FGHI, with the incorporation of the counter balance assembly 150, the handling force remains well within the safety limits, even in the case of failure of one of the gas springs. Of course, the use of the gas springs in this illustrative embodiment is not critical to the practice of the present invention.

Similarly, the use of the Producer deposition system in the present disclosure is meant to be illustrative only. The counter balance spring mechanism is generally applicable to lid assemblies of different chambers, including, but not limited to wafer processing systems. Of course, the balance point and counter balance engaging positions will vary with individual lid assemblies, but the design of the housing assembly and choice of the spring can readily be adapted to meet specific force requirements.

Although several preferred embodiments which incorporate the teachings of the present invention have been shown and described in detail, those skilled in the art can readily devise many other varied embodiments that still incorporate these teachings.

What is claimed is:

1. A counter balance assembly for a lid assembly comprising:

a spring disposed inside a housing mounted on a lid, wherein a restoring force acting upon said lid is generated by said spring in response to an external force created by a displacement of said lid from a reference position, said external force is directed substantially along a longitudinal axis of said spring, the restoring force is generated when said displacement of said lid exceeds a pre-determined displacement threshold with respect to said reference position of said lid; and the reference position corresponds to a closed position of said lid and said pre-determined threshold is about 60° of angular displacement of said lid from said closed position.

2. The counter balance assembly of claim 1, wherein said restoring force has a magnitude that increases with said displacement of said lid from said reference position.

3. The counter balance assembly of claim 1, wherein said restoring force counteracting against said lid displacement increases with said lid displacement.

4. The counter balance assembly of claim 1, wherein said restoring force is generated by compressing said spring.

5. A counter balance assembly for a lid assembly comprising:

a spring disposed inside a housing mounted on a lid;

wherein a restoring force acting upon said lid is generated by said spring in response to an external force created by a displacement of said lid from a reference position, said external force directed substantially along a longitudinal axis of said spring and a first torque about a lid pivot point is created by a first inertial force acting on said lid when said lid displacement exceeds a pre-determined threshold, a second torque is created by said restoring force to counteract said first torque, and a resultant torque is given by a difference between said first and said second torques.

6.The counter balance assembly of claim 5, wherein said pre-determined displacement threshold is selected to maintain a net handle force required to counterbalance said resultant torque to be less than a pre-determined limit.

7. A counter balance assembly comprising:

a housing assembly having a top housing member mounted on a lid and a bottom housing member connected to said top housing member, where said bottom housing member is movable relative to said top housing member and having a predetermined angular displacement; and a spring having a first end retained inside said bottom housing member and a second end retained in said top housing member;

said spring generating a restoring force acting against said lid in response to an external force which decreases said distance between said top housing member and said bottom housing member; and said pre-determined angular displacement is about 60°.

8. The counter balance assembly of claim 7, wherein said external force is generated when said lid is disposed to an angular displacement greater than a pre-determined value from a reference position of said lid.

9. A counter balance assembly comprising:

a housing assembly having a top housing member mounted on a lid and a bottom housing member connected to said top housing member, where said bottom housing member is movable relative to said top housing member;

said top housing member has a counterbored top opening connected to a second opening extending to a bottom surface of said top housing member;

said bottom housing member has a top opening extending partially into said bottom housing member and connecting with a tapped hole in the bottom housing member;

a spring having a first end retained inside said bottom housing member and a second end retained inside said top housing member;

said spring resides partly inside said second opening of said top housing member and partly inside said top opening of said bottom housing member;

said top and bottom housing members are connected by a screw having a head portion residing inside said counterbored top opening of said top housing member and a threaded end engaged to said tapped hole of said bottom housing member; and said screw is disposed coaxially with said spring.

10. A wafer processing system comprising:

a lid mounted upon a chamber;

a counter balance assembly comprising a spring inside a housing assembly mounted on said lid, wherein said counter balance assembly generates a restoring force to counteract a first inertial force resulting from a lid displacement, and said restoring force is generated in response to an external force acting on said housing assembly in a direction substantially along a longitudinal axis of said spring when said lid displacement exceeds a pre-determined displacement threshold from a reference position;

said housing assembly and said chamber cooperate to generate said restoring force; and said external force is generated when said housing assembly abuts against a wall of said wafer processing system and said restoring force arises from a compression of said spring.

11. The wafer processing system of claim 10, wherein a first torque is created by said first inertial force about a lid pivot point, a second torque is created by said restoring force acting about said lid pivot point, said first and second torques giving rise to a resultant torque which is less than said first torque, and said pre-determined displacement threshold is selected to maintain a net handle force required to counterbalance said resultant torque to be less than a pre-determined limit.

12. The wafer processing system of claim 11, wherein said pre-determined limit is about 22 lbs.

13. A wafer processing system comprising:

a lid mounted upon a chamber;

a counter balance assembly comprising a spring inside a housing assembly mounted on said lid;

wherein said counter balance assembly generates a restoring force to counteract a first inertial force resulting from a lid displacement, and a second restoring force is generated in response to an external force acting on said housing assembly in a direction substantially along a longitudinal axis of said spring when said lid displacement exceeds a pre-determined displacement threshold from a reference position;

said reference position corresponds to a closed position of said lid;

and said pre-determined displacement threshold is a displacement angle of about 60°.

14. A wafer processing system comprising:

a lid mounted upon a chamber;

a counter balance assembly comprising a spring inside a housing assembly mounted on said lid;

wherein said counter balance assembly generates a restoring force to counteract a first inertial force resulting from a lid displacement; and said restoring force is generated in response to an external force acting on said housing assembly in a direction substantially along a longitudinal axis of said spring when said lid displacement exceeds a predetermined displacement threshold from a reference position;

said housing assembly further comprises:

a top housing member having a counterbored top opening connected to a second opening extending to a bottom surface of said top housing member;

a bottom housing member having a top opening extending partially into said bottom housing member and connecting with a tapped hole in the bottom housing member;

said spring residing partly inside said second opening of said top housing member and partly inside said top opening of said bottom housing member;

said top and bottom housing members being connected by a screw having a head portion residing inside said counterbored top opening of said top housing member and a threaded end engaged to said tapped hole of said bottom housing member; and said screw is disposed coaxially with said spring.

* * * * *

UNITED STATES PATENT AND TRADEMARK OFFICE

CERTIFICATE OF CORRECTION

PATENT NO. : 6,296,142 B1
DATED : October 2, 2001
INVENTOR(S) : Nguyen

It is certified that error appears in the above-identified patent and that said Letters Patent is hereby corrected as shown below:

Drawings

Sheet 1, Figure 1, the reference numeral 100 (and attendant lead arrow) should be applied to the entire depicted structure;

Sheet 1, Figure 1, a lead arrow should project from reference numeral 112 to the open space on the left side of body 102 directly below the said reference numeral;

Sheet 1, Figure 1, the reference numeral 125 (and its attendant lead line) should be applied to the ledge upon which chamber body 120 is attached.

Signed and Sealed this

Twenty-third Day of April, 2002

*Attest:*

*Attesting Officer*

JAMES E. ROGAN
*Director of the United States Patent and Trademark Office*